United States Patent [19]

Bedard et al.

[11] 4,218,635

[45] Aug. 19, 1980

[54] ELECTRON GUN WITH STATIONARY BEAM DURING BLANKING

[75] Inventors: James F. Bedard, Schenectady; William C. Hughes, Scotia, both of N.Y.

[73] Assignee: General Electric Company, Schenectady, N.Y.

[21] Appl. No.: 23,096

[22] Filed: Mar. 23, 1979

[51] Int. Cl.[2] ..... H01J 29/70

[52] U.S. Cl. ..... 315/17; 315/384; 313/439

[58] Field of Search ..... 315/17, 384, 383, 385, 315/365; 313/421, 429, 432, 439

[56] References Cited

U.S. PATENT DOCUMENTS

| | | | |
|---|---|---|---|
| 3,202,864 | 8/1965 | Crowell | 315/365 |
| 3,562,557 | 2/1971 | Gates | 315/384 |

*Primary Examiner*—Theodore M. Blum

*Attorney, Agent, or Firm*—Geoffrey H. Krauss; James C. Davis; Marvin Snyder

[57] ABSTRACT

Shifting of the electron beam emitted from an electron gun is eliminated by placement of deflection electrodes between the electron gun anode and object electrode, whereby the electron beam, during blanking, is deflected away from the electron gun central axis and caused to totally impinge upon blanking and spray electrodes. For deflections less than the deflection required for total blanking, the electron beam is diminished in intensity but is not moved in position from the central gun axis.

5 Claims, 9 Drawing Figures

Fig. 2
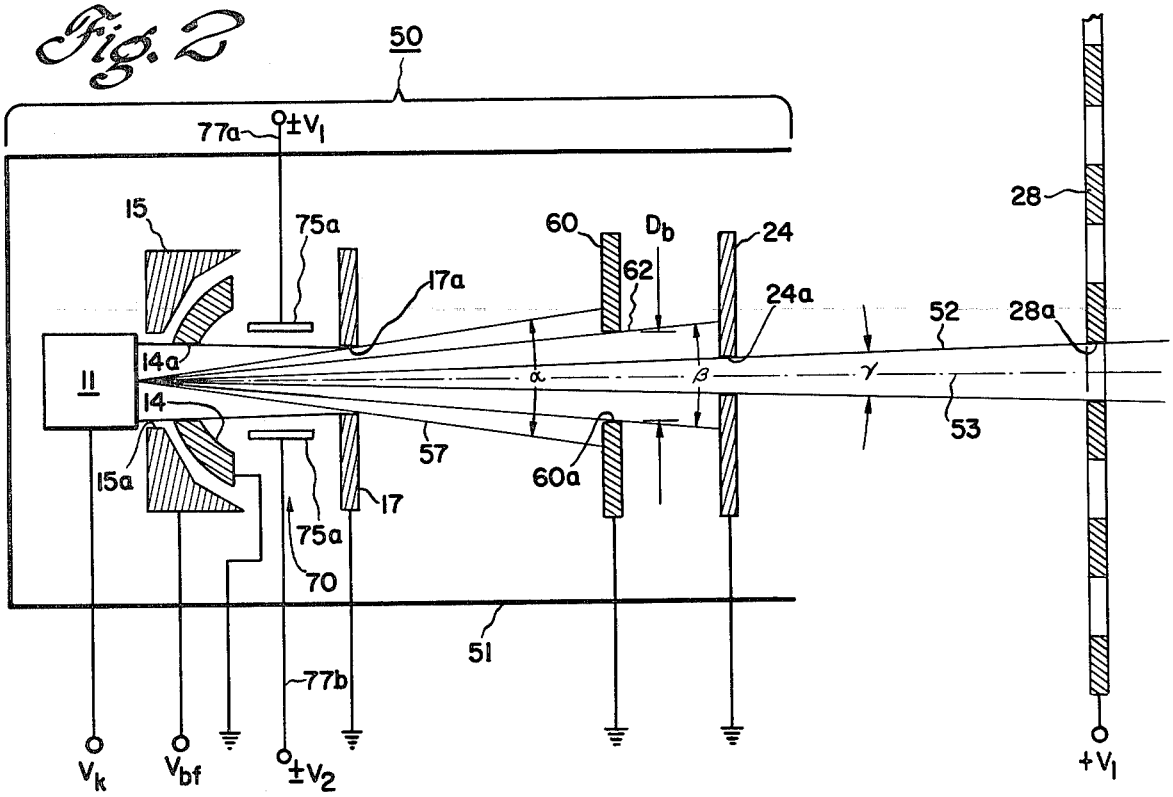
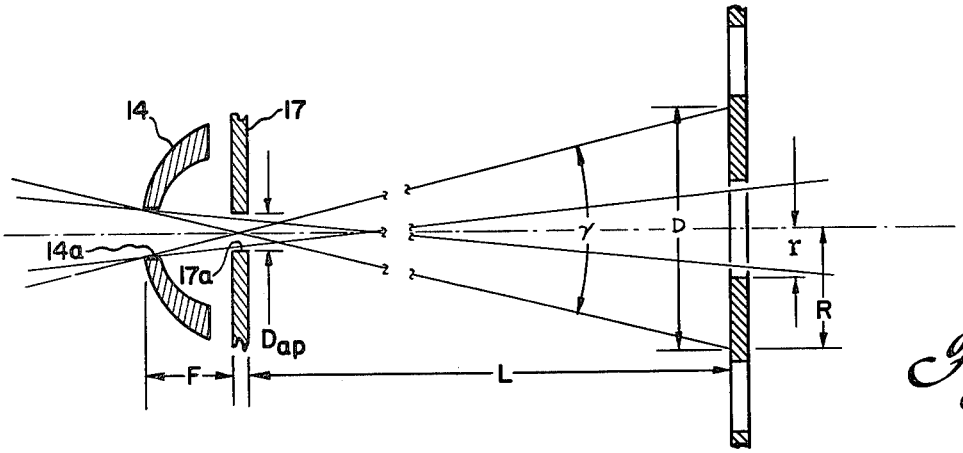
Fig. 2b
Fig. 2a
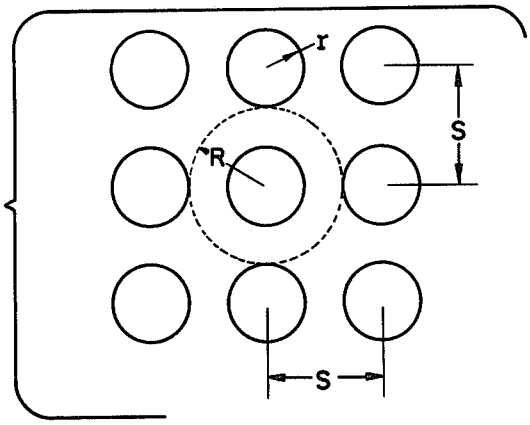

53
$P_0$
77a
77
$P_1$
78a
78
$P_2$
79a
79
$P_3$
$V_1=0$
75a
17
60
OBJECT APERTURE
BLANKING APERTURE
SPRAY APERTURE
LENS
80
53
$\phi$
$\alpha$
$\beta$
$\gamma$
14a
17a
57
60a
62
24a
52
28a
14
24
28
75b
ANODE
$V_2=0$
DEFLECTION 53
77a'
$P_0'$
77'
$P_1'$
78a'
78'
$P_2'$
79a'
79'
$P_3'<P_3$
$V_1=0$
14
75a
80'
60
24
80
17a
60a
24a
28
53
$\alpha$
$\beta$
$\gamma$
$E_d$
14a
17
57'
62'
52'
28a
75b
$V_2$ 53
$P_0''$
77a''
77''
$P_1''$
78''
78a''
$P_2''$
79a''
79''
$P_3''\approx 0$
$V_1=0$
14
75a
17
60
24
28
80
80''
60a
24a
28a
53
14a
$E_d'$
17a
57''
62''
75b
$V_2$ spray electrode potential $V_b$, the diameter of electron beam 26 emerging from the electron gun at spray electrode 24. The beam 26 passes through a lenslet aperture 28*a*, in a lens member 28, maintained at a lens potential $V_1$, toward the surface of target 20 facing the electron gun. Target 20 is maintained at a target potential $V_t$, which, in conjunction with the lens potential $V_1$, the spacing between target 20 and lens 28, and other factors and elements (as more fully described, for example, in U.S. Pat. Nos. 3,534,219, issued Oct. 13, 1970 and 3,919,588, issued Nov. 11, 1975, both incorporated herein by reference) act to focus the beam upon the surface of target 20.

To provide maximum current in the beam 30 impinging upon the target surface, the diameter of beam 22 impinging upon the cathode-facing surface of spray electrode 24 should be only slightly greater than the diameter of spray aperture 24*a* and the diameter of the spray aperture should be such that the diameter of beam 26 is substantially equal to the diameter of lenslet aperture 28*a*. The beam diameter is established, as previously mentioned, by the diameter of object aperture 17*a*, which object aperture diameter is focused upon the target surface; it is desirable that the diameter of object aperture 17*a* be relatively small, to provide a relatively small electron beam spot diameter on the target.

In many applications, such as information storage, beam 26 must vary between the lenslet-aperture-illuminating condition, wherein beam 26 passes through lenslet 28*a* to be focused on target 20, and the beam-blanked condition, wherein the beam is diverted from the lenslet such that beam current is not impingent upon the target. Heretofore, this beam blanking, or beam modulation, function has been achieved by either electrostatic blanking (FIG. 1*a*) or electromagnetic blanking (FIG. 1*b*) in the volume between object electrode 17 and spray electrode 24. Thus, in the electrostatic blanking configuration of FIG. 1*a*, two blanking electrodes 33*a* and 33*b* parallel to each other and to the electron gun axis 12, and receiving a first blanking potential $V_b$ are utilized. The electrode positions and blanking potentials are established to generate a blanking electric field $E_b$ (illustratively in the vertical direction for the horizontally-disposed blanking plates acting upon the horizontally-traveling electron beam 22) in the blanking volume between electrodes 17 and 24. The blanking field acts upon the electrons of beam 22 to cause the deflected beam 22*a* to be completely diverted from the spray aperture 24*a* and eventually impinge upon the spray electrode wall. In the magnetic blanking configuration of FIG. 1*b*, a blanking solenoid 37, typically positioned annularly about cathode 11 and having a blanking current $I_b$ flowing therethrough, forms a magnetic blanking field $B_b$ in the blanking volume between electrode 17 and 24 and similarly acts upon electron beam 22, to divert the beam, as beam 22*a*′ (shown in broken line), ultimately to impinge upon spray electrode 24. In either case, the beam is ultimately deflected from spray aperture 24*a* and the magnitude of current in beam 26, entering lenslet aperture 28*a*, falls essentially to zero. However, as the electron beam is deflected from beam central axis 12, the beam appears to move with respect to lenslet aperture 28*a*, as illustrated by an intermediate-positioned beam 26*a* and 26*a*′, respectively, (shown in chain line) and appears to illuminate the lenslet aperture from varyng angles during blanking movement. This angularly-varying illumination causes movement of the beam 30′ focused upon the target, rather than providing a stationary beam during blanking action.

Referring now to FIGS. 2, 2*a* and 2*b*, wherein like reference designations are utilized for like elements, an electron gun 50, in accordance with the present invention, is contained within a vacuum envelope 51 and is utilized for directing a beam 52 of electrons along an electron gun axis 53, illustratively rightwardly, through an aperture 28*a* in a lens electrode 28, maintained at a lens potential of $V_1$, for eventual focusing upon a target (not shown). Cathode 11, at cathode potential $V_K$, emits electrons which pass through the central aperture 15*a* of beam-former electrode 15, maintained at a potential $V_{bf}$, and then through the aperture 14*a* in anode electrode 14, maintained at electrical ground potential. The beam 55, thus formed and directed along axis 53, passes through the central object aperture 17*a* of an object electrode 17, also maintained at electrical ground potential, and emerges therefrom as a beam 57 having a relatively large dispersion angle $\alpha$. The magnitude of dispersion angle $\alpha$ is established by the focal length F between the edge of anode electrode 14 closest to the cathode and the nearest surface of object aperture 17, as well as by the object aperture diameter $D_{ap}$ (FIG. 2*b*). The diverging beam continues to travel along the axis 53, in the direction of lens electrode 28, and encounters a blanking electrode 60, disposed transverse to axis 53 and maintained at electrical ground potential. Blanking electrode 60 has a blanking aperture 60*a* located therein and centered about axis 53. The diameter $D_b$ of blanking aperture 60*a* is less than the diameter of diverging electron beam 57 impingent thereon, and serves to further limit the dispersion angle of the beam 62 leaving the blanking aperture, to a dispersion angle $\beta$, less than dispersion angle $\alpha$. Beam 62 passes through spray aperture 24*a* in spray electrode 24, maintained at ground potential. The dispersion angle $\gamma$ of beam 52, leaving the electron gun at spray aperture 24*a*, is less than dispersion angle $\beta$ and is established such that the maximum diameter D of the beam impingent upon lens electrode 28, situated at a distance L from object electrode 17, is no greater than twice the maximum radius R between the center of a desired lenslet aperture 28*a* (to which the beam may be deflected) which desired aperture the beam enters perpendicular to the plane of the lens member, and the nearest edge of the nearest apertures in the array of apertures in lens member 28. Thus, as seen in FIG. 2*a*, if lens member 28 has a two-dimensional array of apertures 28*a* formed therethrough, with an aperture center-to-center spacing S therebetween and an aperture radius r, the maximum desired diameter D of the beam impinging upon a lenslet member is established by the desired lenslet to adjacent-lenslet radius R. In a typical embodiment, wherein the lenslet aperture spacing S is on the order of 60 milli-inches and the lenslet radius r is on the order of 15 milli-inches, the maximum desired beam radius R is about 45 milli-inches and the maximum beam diameter D impingent upon the lens member is on the order of 90 milli-inches. In this particular application, the object aperture diameter Dap is 1.5 milli-inches with an object-to-lens member spacing L of 11.0 inches, for an electron gun having a beam current density of three amperes per square centimeter, at the target, with an acceleration potential (essentially equal to cathode voltage $V_k$, of 4 kV.) with the focal length F being established at 1.375 inches.

In accordance with the invention, beam 52 is modulated in manner such that there is no apparent beam

ELECTRON GUN WITH STATIONARY BEAM DURING BLANKING

BACKGROUND OF THE INVENTION

The present invention relates to electron guns for emitting beams of electrons and, more particularly, to a novel electron gun emitting a blankable electron beam which appears, at a target external to the electron gun, to remain stationary on the electron gun axis and vary only in intensity and not in position.

Electron beam-emitting means are useful for a large class of apparatus, including electron-beam-addressable memories of the type discussed and claimed in U.S. Pat. No. 3,534,219, issued Oct. 13, 1970, assigned to the assignee of the present invention and incorporated herein by reference. In such electron-beam-addressable memories, the electron beam is deflected to pass through one of a multiplicity of arrayed apertures in a lens electrode and with the electron beam current density being modulatable to values thereof between essentially zero current density and the full current density available from the electron gun. During modulation, the electron beam emitted from the electron gun often exhibits spatial movement, as well as intensity change, with these spatial movements causing the electron beam to impinge upon other lens apertures and address memory target sites other than the target site which it is desired to access at that particular instant. It is therefore desirable to provide an electron gun which is not only capable of being modulated, to change the current intensity of the beam emitted therefrom, but which is also capable of providing an electron beam lying substantially along the central axis of the electron gun for all values of beam current intensity, and without spatial motion of the beam at the target.

BRIEF SUMMARY OF THE INVENTION

In accordance with the invention, an electron gun having a stationary electron beam during blanking, includes a cathode emitting electrons toward an anode and having a beam-forming electrode disposed therebetween for forming the emitted electrons into a converging beam; an object electrode, upon which the converging beam falls, having an object aperture for establishing the diameter of the beam; and electrostatic deflection apparatus positioned about an electron gun axis extending from the cathode through the beam forming, anode and object electrode apertures, for deflecting the electron beam from the anode through the object aperture at an angle sufficient to cause the deflected beam to impinge upon at least one of successive blanking and spray electrodes succesively situated beyond the object electrode, with respect to the cathode, whereby all of the beam current is absorbed by the blanking and spray electrodes upon which the beam impinges, and whereby, in a lesser-deflected condition, the beam passes through apertures in the blanking and spray electrodes and is emitted outwardly from the spray electrode as a beam, always situated substantially along the central axis of electron gun and varying only in electron beam current intensity and without substantial spatial variation during blanking.

In a preferred embodiment, the beam deflection electrode situated between the anode and object electrodes includes a horizontally-disposed pair of deflection plates. Each deflection plate of the pair is situated parallel to the other deflection plate and to the electron gun central axis. Two pairs of deflection plates may be used with each pair of plates being disposed substantially orthogonal to the other deflection plate pairs and parallel to the central gun axis.

Accordingly, it is one object of the present invention to provide novel deflection means for an electron gun, whereby the electron beam may be varied in current intensity without inducing spatial motion thereto.

This and other objects of the present invention will become apparent upon consideration of the following detailed description, when taken in conjunction with the drawings.

BRIEF DESCRIPTION OF THE DRAWINGS

FIG. 2 is a partially-sectionalized sideview of a blankable electron gun, in accordance with principles of the present invention, and with lens and target members with which the novel electron gun may be used;

FIG. 2*a* is a front view of a portion of the lens member of FIG. 2;

FIG. 2*b* is a sectionalized sideview of a portion of the electron gun and of the lens member of FIG. 2, and useful in understanding principles of the present invention;

DETAILED DESCRIPTION OF THE INVENTION

Figure 1A:
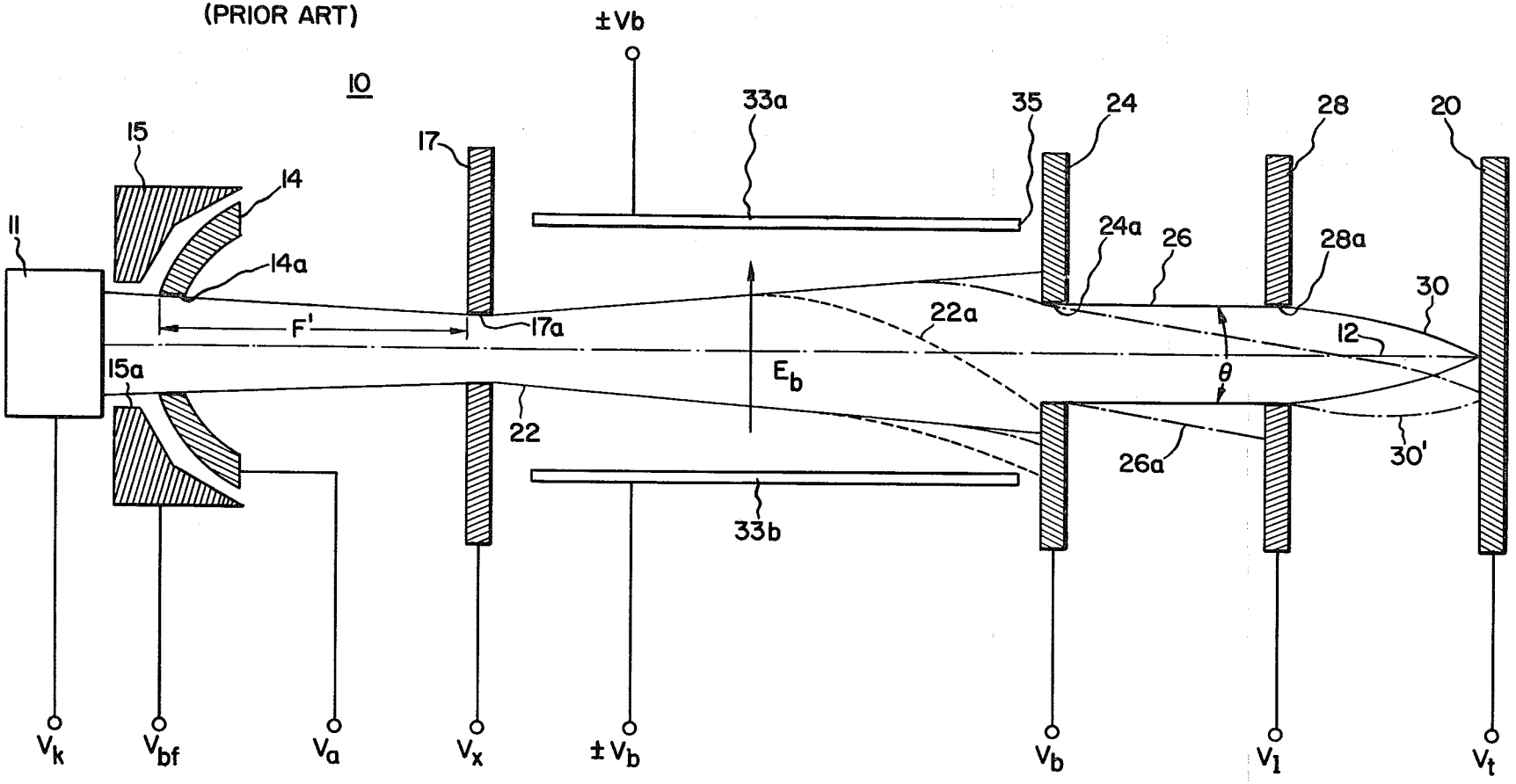
Fig. 1a (PRIOR ART)
FIGS. 1*a* and 1*b* are partially-sectionalized sideviews of prior art blankable electron guns and of lens members and targets with which the electron guns may be utilized.
Figure 1B:
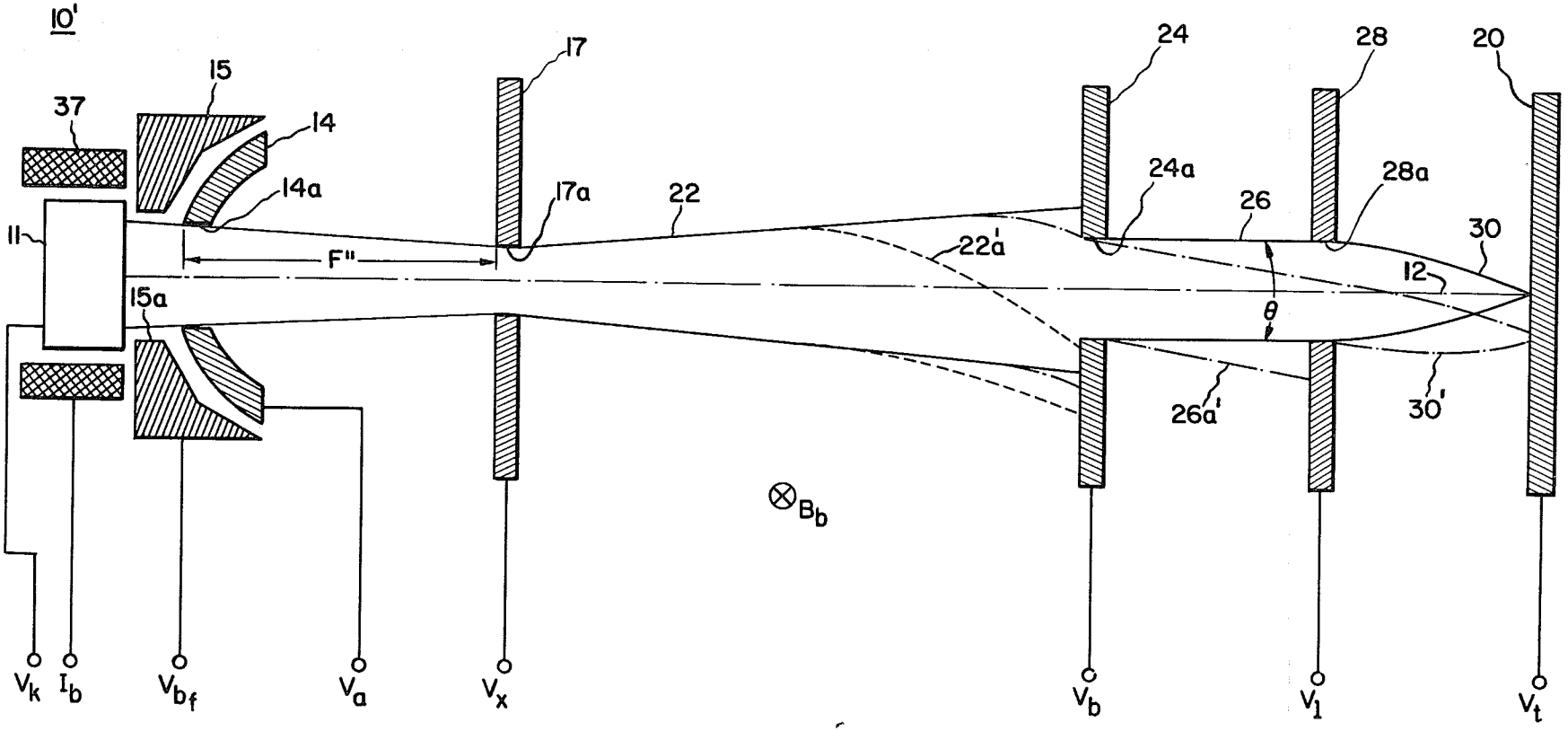
Fig. 1b (PRIOR ART)

Referring now to FIGS. 1*a* and 1*b*, which are not drawn to scale, prior art electron guns 10 and 10' each include a cathode 11, at some cathode potential $V_k$, for emitting electrons along an electron gun axis 12. The emitted electrons are attracted to an anode 14, at an anode potential $V_a$, and pass through an aperture 14*a* therein; the electrons are formed into a converging beam, directed along axis 12, by action of anode 14 and of a beam-forming electrode 15, at a beam forming potential $V_{bf}$, and having a central aperture 15*a* therein. Beam-forming electrode 15 is positioned between cathode 11 and anode 14 and has its aperture 15*a* centered on axis 12. An object electrode 17 is positioned transverse to the direction of axis 12 and has an object aperture 17*a* formed therein and centered about the axis; object electrode 17 is positioned at a focal distance F' or F'', respectively, on the opposite side of anode aperture 14*a* from cathode 11. The diameter of object aperture 17*a* establishes an electron beam spot size which is to be transferred to a target 20 located at the opposite end of axis 12 from cathode 11. The electron beam 22, leaving object aperture 17*a*, passes along beam axis 12 and through a spray aperture 24*a*, centered about the axis, in a spray electrode 24 located between object electrode 17 and the target and positioned transverse to axis 12. The diameter of spray aperture 24*a* is somewhat less than the diameter of the diverging electron beam impingent thereon and establishes, in conjunction with the motion at the target during blanking, by means of electrostatic blanking apparatus 70 positioned between the anode 14 and the object electrode 17. Electrostatic blanking apparatus 70 includes a set of two electrostatic blanking plates 75*a* and 75*b*, arranged parallel to one another and to electron gun axis 53, and, as illustrated with a horizontally-disclosed electron gun axis, being disposed with horizontal orientation. A second pair of blanking plates 75 (not shown for purposes of simplicity) may be disposed parallel to one another and to axis 53, and also orthogonal to the first pair of plates 75*a* and 75*b*; thus, the second pair of blanking plates, if used, would illustratively be disposed vertically and parallel to the plane of the drawing. Each of blanking plates 75*a* and 75*b*, respectively, of the horizontally-disposed blanking plate pair, has connected thereto a lead 77*a* and 77*b*, respectively, by which blanking potentials, e.g. $\pm V_1$ and $\pm V_2$, respectively, may be impressed upon the associated blanking plate.

Figure 3A:
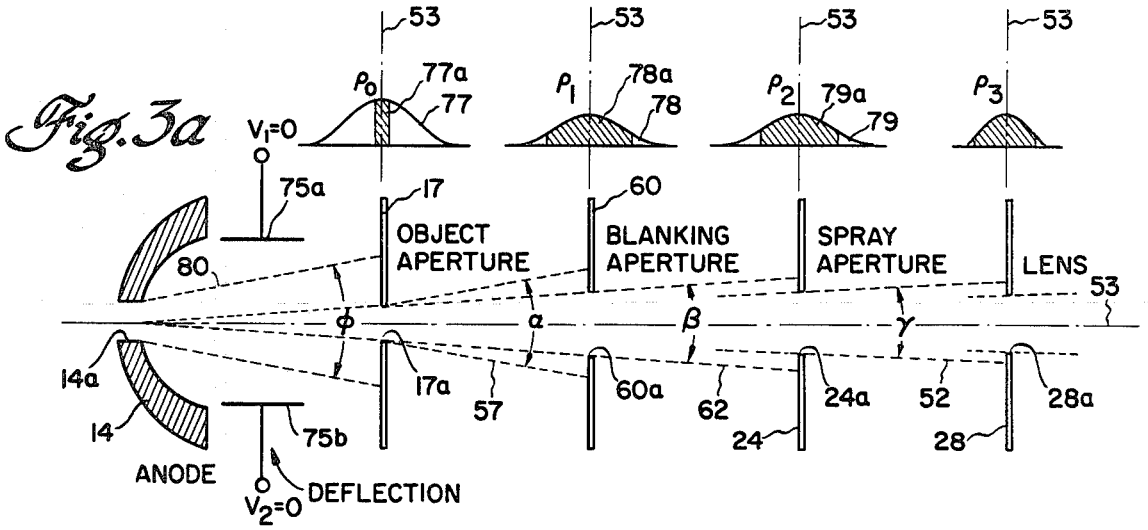
FIGS. 3*a*, 3*b* and 3*c* are a set of sideviews of the electron gun in accordance with the present invention, and of a lens member with which the electron gun may be used, and illustrating the lack of movement of the electron beam emitted from the electron gun and the modulation of the current intensity only.
Figure 3B:
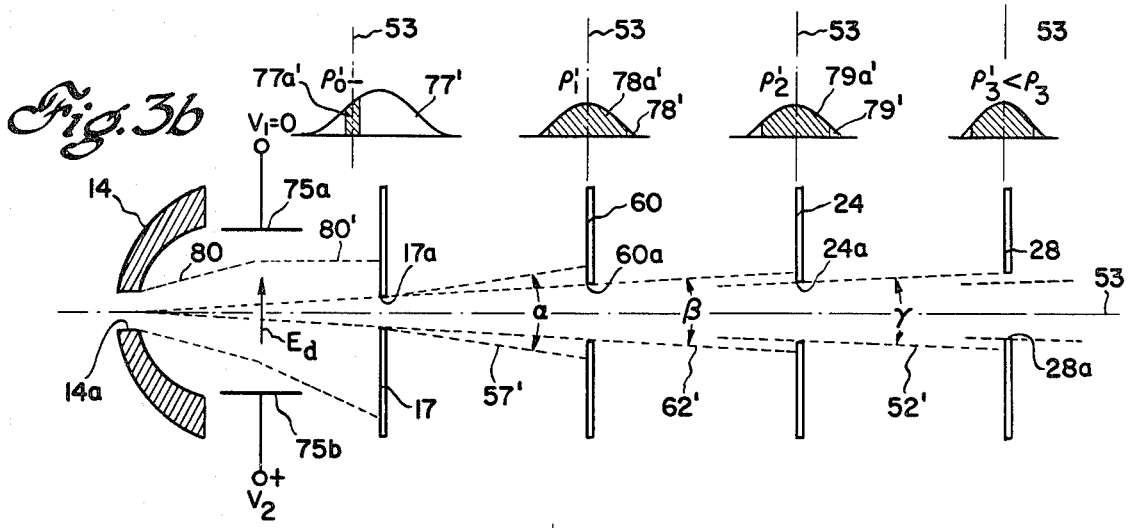
Figure 3C:
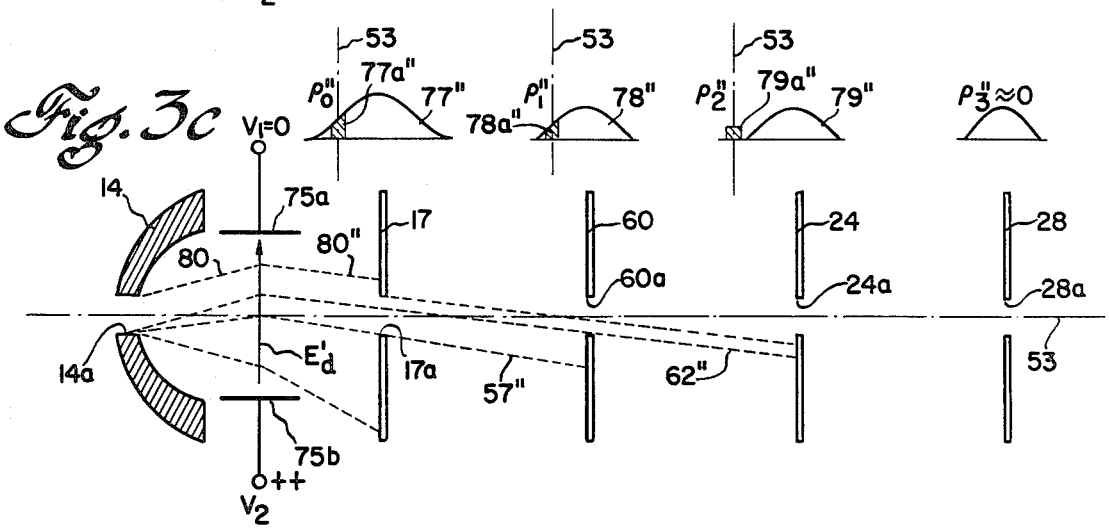

Referring now to FIGS. 3*a*–3*c*, the blanking effect of the novel blanking electrodes, intermediate the anode and object electrodes, is illustrated. In FIG. 3*a*, the deflection voltages $V_1$ and $V_2$ respectively, impressed upon horizontally-disposed deflection plates 75*a* and 75*b*, respectively, are essentially zero. The electron beam 80 emitted from anode aperture 14*a* has a wide divergence angle $\phi$. As there is no deflection potential impressed upon either of plate 75*a* and 75*b*, electrons of beam 80 travel rightwardly and arrive at the plane of object electrode 17 with a substantially Gaussian intensity distribution radially disposed about axis 53. Beam 80 illuminates object aperture 17*a* as well as adjacent portions of electrode 17. Accordingly, only those electron illuminating the object aperture, located now at the center of the beam, pass therethrough to form beam 57, having divergence angle $\alpha$, less than divergence angle $\phi$. Graphically, the Gaussian distribution of electron current impinging upon the plane of electrode 17 is shown immediately above the object aperture position; the shaded area 77*a* at the center of the Gaussian curve 77 illustrates the relative portion of the entering electron beam 80 passing through the aperture and providing an object current density $\rho_0$. Beam 57 travels along optical axis 53 and diverges to have another, substantially Gaussian current distribution 78 (illustrated graphically above the location of blanking electrode 60) upon arrival at the plane of the blanking electrode; the central portion (area 78*a*) of beam 57 passes through blanking aperture 60*a* and provides beam 62 with a somewhat narrower divergence angle $\beta$, in which the current density $\rho_1$ is of somewhat lesser magnitude than the density $\rho_0$ of the current passing through the object aperture. Beam 62 continues traveling along axis 53, diverging to provide the current density distribution 79 at the plane of spray aperture 24. The major portion (area 79*a*) of the current beam 62 passes through the spray aperture to emerge as beam 52, having a divergence angle $\gamma$ less than the divergence angle $\beta$, for impingement upon lenslet aperture 28*a*. As seen in the graphic illustration above the spray aperture, the current density $\rho_2$ of beam 52 is less than the current density $\rho_1$ of beam 62 emerging from the blanking aperture. Accordingly, the current distribution $\rho_3$ impingent upon aperture 28*a* is somewhat less than distribution $\rho_2$ of the beam leaving the spray aperture, as beam 52 impinges upon portions of the lens electrode 28 annularly positioned about the lens aperture. The beam current, of distribution $\rho_3$, passing through lenslet 28*a* is subsequently impingent upon the target (not shown).

In FIG. 3*b*, a small positive potential is impressed upon lower horizontally-disposed deflection plate 75*b*, while the remaining (upper) horizontally-disposed deflection plate 75*a* is maintained at a different voltage; in the illustration, the upper deflection electrode voltage $V_1$ is substantially at electrical ground potential. The electron beam 80 emerging from anode aperture 14*a* encounters the deflection apparatus electrical field $E_d$, directed upwardly from electrode 75*b* (having a positive potential $V_2$ impressed thereon, toward upper electrode 75*a*, at ground potential), and the beam is deflected downwardly. The resulting beam 80' arrives at the plane of object electrode 17 with the substantially Gaussian distribution, but with the peak thereof having been moved downwardly such that the portion of distribution curve 77' at axis 53 is no longer at the maximum of the substantially Gaussian distribution curve. The current passing through small diameter object aperture 17*a* is shown by the shaded area 77*a'* of the curve and has a current density $\rho'_0$, less than the current density $\rho_0$ of the undeflected beam of FIG. 3*a*. This current passes through the object aperture and emerges as beam 57', having the same divergence angle $\alpha$ but of somewhat lesser magnitude than beam 57. Beam 57' continues to diverge until arrival at the plane of blanking electrode 60, at which plane the current distribution, illustrated graphically thereabove, has a substantially Gaussian distribution curve 78' and an essentially identical portion (area 78*a*) of the current, in the no-deflection case of FIG. 3*a*, of entering beam 57' passes through blanking aperture 60*a*, having divergence angle $\beta$. The total current density of emerging beam 62' is attenuated, relative to the current density $\rho_1$ of the no-deflection case, in ratio substantially equal to the ratio of the beam current density $\rho'_0$ in the partially-deflected case of FIG. 3*b*, to the current density $\rho_0$ of the no-deflection case of FIG. 3*a*. Beam 62' passes through spray aperture 24*a* and, as entering divergence angle $\beta$ is equal in both the partially-deflected and no-deflection cases, the beam 52' directed at lenslet aperture 28*a* has similar divergence angle $\gamma$ but arrives at the plane of lens member 28 with a current density $\rho_3'$ of lesser magnitude that the current density $\rho_3$ in the no-deflection case. In both cases, there is negligible beam motion at lens electrode 28 and no movement of the beam subsequently impingent upon a target. It should be noted that fine variation of the deflection electrode voltages $V_1$ and $V_2$ allow fine variations in the magnitude of the beam current emitted from the electron gun at spray aperture 24*a*.

In FIG. 3*c*, a relatively large deflection voltage is provided to deflection apparatus 70. Illustratively, with the deflection voltage $V_1$ to upper deflection plate 75*a* beam maintained at ground potential, the deflection voltage $V_2$ to the lower, horizontally-disposed deflection plate 75*b*, is maintained at a high positive potential, whereby the electric field $E_d'$ is of large magnitude. Full-deflection field $E_d'$ is sufficient to deflect the electron beam 80, emitted from anode aperture 14*a*, such that the peak of the substantially Gaussian current distribution, impingent upon the object electrode plane, is centered far enough below the electron gun axis 53 such that the deflected beam 80'' passing through object aperture 17*a* substantially completely impinges upon the blanking electrode 60 and spray electrode 24 surfaces, such that essentially no current leaves the electron gun at spray aperture 24*a*, thereby reducing the amplitude of the beam at lens electrode 28 essentially to zero and completely blanking the beam from the electron gun. As seen in FIG. 3*c*, in the event that any portion of beam 80″ does pass through object aperture 17*a*, as a beam 57″, the beam 57″ leaving object aperture 17*a* is tilted away from axis 53 to a sufficient degree such that the current distribution curve 78″ of beam 57″, at the plane of blanking electrode 60, is such that only a small portion 78*a*″ pass, if at all, through blanking aperture 60*a* and that portion, if present, forms a beam 62″, also directed away from axis 53 and totally impinging upon spray electrode 24, whereby no portion of the current distribution impingent upon spray electrode 24 passes through spray aperture 24*a*. Thus, the beam is completely blanked, with no beam current reaching the lens electrode, and without movement of the beam apparent at the target surface, even as the beam current density is blanked to zero.

Figure 4:
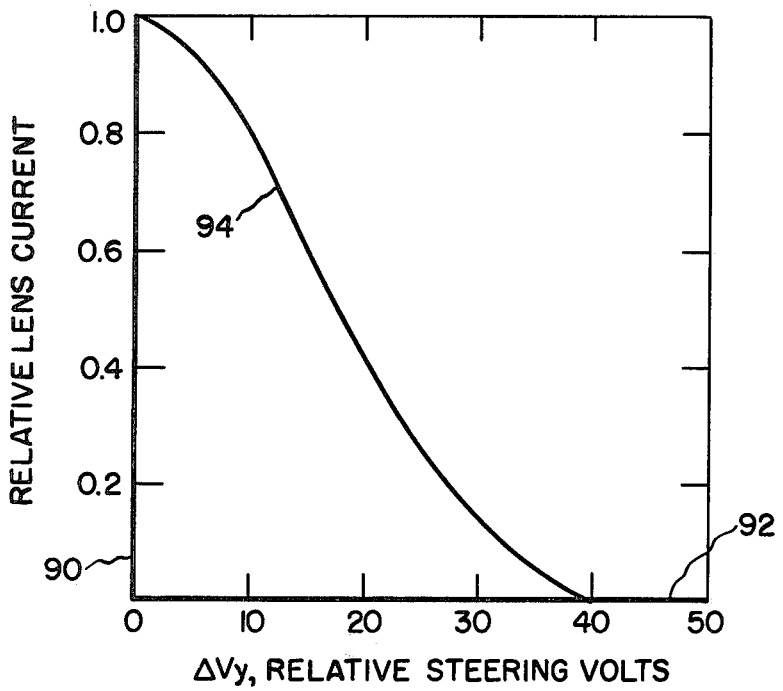
FIG. 4 is a graph illustrating the beam current intensity modulation vs. deflection voltage function.

Referring now to FIG. 4, the relative current intensity of the beam reaching a lens aperture 28*a* (FIG. 2), as a function of the difference in the beam deflection voltages supplied to a pair of deflection plates 75, is illustrated for one particular preferred arrangement. The relative current I received at the lens aperture is plotted for increasing values along ordinate 90 with the relative steering volts $\Delta V_y$ being plotted along abscissa 92, where $\Delta V_y$ is the difference between the first deflection voltage $V_1$ supplied, e.g., to horizontally-disposed upper deflection electrode 75*a*, and the second deflection voltage $V_2$ supplied, e.g., to horizontally-disposed lower deflection electrode 75*b*. Intensity curve 94 illustrates that, for a differential deflection voltage of 0 volts, i.e. equal first and second deflection voltages $V_1$ and $V_2$, the beam current attains its maximum value. In an electron gun having parameters set forth hereinabove, a relative steering voltage of 10 volts, e.g. one of first and second voltages $V_1$ and $V_2$ being of 10 volts greater magnitude than the remaining deflection voltage, the magnitude of the beam current emitted from the electron gun (from spray aperture 24*a*) decreases to about 80% of the maximum, but with the decreased magnitude current beam still lying substantially along the central electron gun axis. A further increase in the differential voltage $\Delta V_y$ between the deflection plates 75 results in continued decrease in the beam current; with one of the deflection plate voltages being 20 volts greater than the remaining deflection voltage, the beam current falls to approximately 40% of the maximum beam current, but with the emitted electron beam still lying along the central gun axis. With the particular parameters selected for this electron gun, a difference of 40 volts in the relative steering voltages causes the electron beam to be deflected, within the electron gun, whereby essentially no electrons of the beam are emitted from the electron gun and the beam current intensity falls essentially to zero.

It should be understood that blanking of the electron beam by varying the intensity thereof without spatial motion of the beam emitted from the electron gun, may be accomplished with the illustrated single pair of deflection plates, disposed parallel to one another and to the central electron beam axes, without requiring the use of a second pair of deflection plates, whether orthogonally or otherwise disposed with respect to the first pair of deflection plates. Similarly, it should be understood that, whether a single or double pair of deflection plates are utilized between the electron gun anode and object electrodes, it is only necessary that the pair of deflection electrodes have similar orientation with respect to the electron gun central axis and do not have to be either horizontally spaced or vertically-disposed or even parallel to one another; if the pair of deflection plates are not parallel, they are disposed upon diametrically opposite sides of the electron gun axis and the planes of the pair of deflection plates formed substantially similar angles to the central gun axis.

While the present invention has been described with respect to one presently preferred embodiment thereof, many modifications of variations will now occur to those skilled in the art. It is our intent, therefore, to be limited only by the scope of the appending claims and not by the particulars of the embodiment described herein.

What is claimed is:

1. An electron gun for emitting a beam of electrons toward a target, comprising:

means for emitting electrons;

first means including a beam-forming electrode and an anode electrode sequentially arranged adjacent to said electron emitting means for forming the emitted electrons into a beam traveling along an axis of said electron gun and toward said target;

second means situated beyond said beam-forming first means and consisting of an object electrode, a blanking electrode and a spray electrode sequentially arranged each furthest from said electron emitting and first means and each having an aperture formed therethrough and positioned about said electron gun axis for allowing passage of only that portion of the formed beam lying along said axis and having a pre-determined diameter and divergence angle; and blanking means positioned between said anode electrode of said first means and said object electrode of said second means for deflecting the electron beam emitted from said anode electrode of said first means from said axis to modulate the current density of the beam emitted from the electron gun with essentially no spatial motion of the modulated beam impingent on said target and to cause said beam to essentially impinge upon said object, blanking and spray electrodes of said second means when said blanking means receives a signal of at least a magnitude pre-determinately selected to reduce the current of said beam essentially to zero.

2. The electron gun of claim 1, wherein said blanking means comprises means for electrostatically deflecting said beam emerging from the anode electrode of said first means.

3. The electron gun as set forth in claim 2, wherein said electrostatic deflecting means comprises of at least one pair of deflection plates symmetrically arranged about said axis between said anode and object electrodes, and means for providing electrical potentials to said deflection plates for forming an electron deflecting field therebetween.

4. The electron gun as set forth in claim 3, wherein said pair of deflection plates are parallel to one another and to said axis.

5. In combination, the electron gun of claim 1; a target upon which the electron beam emitted by said electron gun is to impinge; and means positioned between said electron gun and said target for focusing said beam upon a surface of said target.

* * * * *